US006626432B2

(12) United States Patent
Rago et al.

(10) Patent No.: US 6,626,432 B2
(45) Date of Patent: Sep. 30, 2003

(54) GAME BOARD AND PLAYING CARD RETENTION CLIPS

(76) Inventors: Dominic Rago, 2942 Roundhill Rd., Alamo, CA (US) 94507; Catherine R. Brent, 4532 Hillsborough Dr., Castro Valley, CA (US) 94546

( * ) Notice: Subject to any disclaimer, the term of this patent is extended or adjusted under 35 U.S.C. 154(b) by 51 days.

(21) Appl. No.: 09/960,798

(22) Filed: Sep. 24, 2001

(65) Prior Publication Data

US 2003/0057647 A1 Mar. 27, 2003

(51) Int. Cl.[7] ..... A63F 3/00

(52) U.S. Cl. ..... 273/287; 273/236; 273/DIG. 30; 273/282.1; 273/282.2

(58) Field of Search ..... 273/148, 282.1, 273/150, 282.2, 309, 269, DIG. 30, 287, 295, 297; 248/459; 108/128

(56) References Cited

U.S. PATENT DOCUMENTS

| | | | | |
|---|---|---|---|---|
| 1,880,175 A | | 9/1932 | Geibel | |
| 2,450,325 A | | 9/1948 | Zirin | |
| 2,453,292 A | | 11/1948 | Zirin | |
| 2,490,649 A | | 12/1949 | Polis | |
| 2,600,951 A | | 6/1952 | Edwards | |
| 3,023,005 A | | 2/1962 | Hochman | |
| 3,635,478 A | | 1/1972 | Hatley | |
| 4,767,119 A | * | 8/1988 | Fadner et al. | 273/148 A |
| 4,901,962 A | * | 2/1990 | Greer | 24/555 |
| 4,964,023 A | * | 10/1990 | Nishizawa et al. | 362/100 |
| 4,971,278 A | * | 11/1990 | Woods | 248/206.5 |
| 5,029,797 A | | 7/1991 | Levorchick et al. | |
| 5,280,914 A | * | 1/1994 | Selby et al. | 273/148 A |
| 5,613,602 A | * | 3/1997 | Lage et al. | 206/232 |
| 6,079,419 A | * | 6/2000 | Perlsweig | 132/201 |
| 6,352,229 B1 | * | 3/2002 | Adams | 24/67 R |

OTHER PUBLICATIONS

US 2002/0105143A1—Patent Application Publication to Ellitt et al. Pub date: Aug. 8, 2002 App. date: Feb. 8, 2001 App. No. 09/779432.*

* cited by examiner

*Primary Examiner*—Benjamin H. Layno
*Assistant Examiner*—Vishu K Mendiratta
(74) *Attorney, Agent, or Firm*—Harris Zimmerman

(57) ABSTRACT

A portable board or platform for playing cards outdoors where wind might blow away cards. A plurality of card engaging members may be placed in any orientation on the playing surface of the board to accommodate a number of cards at selected locations on the platform. The members are releasably secured to the platform by means of hook and loop Velcro type elements, placed on the platform and on the card engaging members respectively.

9 Claims, 2 Drawing Sheets

GAME BOARD AND PLAYING CARD RETENTION CLIPS

BACKGROUND OF THE INVENTION

The present invention generally relates to portable game boards on which various card games may be played outdoors under windy conditions, while preventing cards placed on the board surface from blowing away. More particularly, the board has a plurality of card engaging members capable of releasably holding a number of playing cards, with each of such members being releasably secured to the upper surface of said board in a number of different locations and at a generally infinite number of orientations relative to the edges of the board.

Heretofore, a variety of game boards have been invented for the purpose of facilitating the playing of cards out doors under even windy conditions. However, the boards of the prior art have a number of defects and shortcomings which are overcome by the present invention. By way of example, Hatley U.S. Pat. No. 3,635,478 discloses a board with a plurality of spring arms releasably attached to the board and whose distal ends are urged towards the board and adapted to hold one or a number of playing cards between the ends of the arms and the upper surface of the board. The spring arms may be moved, but only to a limited number of specifically oriented positions on the board.

Similarly, Zirin U.S. Pat. No. 2,453,292 provides resilient card holding clips which may be moved to a number of discrete predetermined locations on the board, but cannot be universally positioned and oriented to better accommodate various games and various number of players.

Other prior art references disclose card boards for holding cards in a number of different ways, such as magnetically or in some form of non-movable or fixed strips.

SUMMARY OF THE INVENTION

The present invention provides a game board which can be folded for storage and opened to provide an upper relatively flat or planar surface on which any number of card games can be played.

To prevent cards placed on such upper surface from blowing away under windy conditions, a plurality of card retaining clips are provided which can be releasably secured to substantially any location on said upper surface, and at any desired angular orientation relative to the edges of the board.

In the preferred embodiment, hook and loop portions of Velcro attachments are respectively applied to the upper surface of the board and to the lower surface of the clips, to permit the releasable securing of the clips to the board.

The clips preferably have a flat base position, an intermediate curved portion extending from one end of the clip and an end position resiliently urged towards the upper surface of the base portion so as to hold one or more cards therebetween.

In a folded condition, the upper surface of the board, bearing one of the Velcro attachments is folded upon itself. However, the edges of the board and/or the lower surface of the board (which is exposed when the board is folded) may also have similar Velcro attachments affixed thereto so that the clips may be conveniently attached to the board when the board is stored or transported. Also, the Velcro attachments may be used as a means for hingedly connecting two parts of the board for folding, and for releasably securing the boards in a folded condition.

DESCRIPTION OF THE PREFERRED EMBODIMENT

Figure 1:
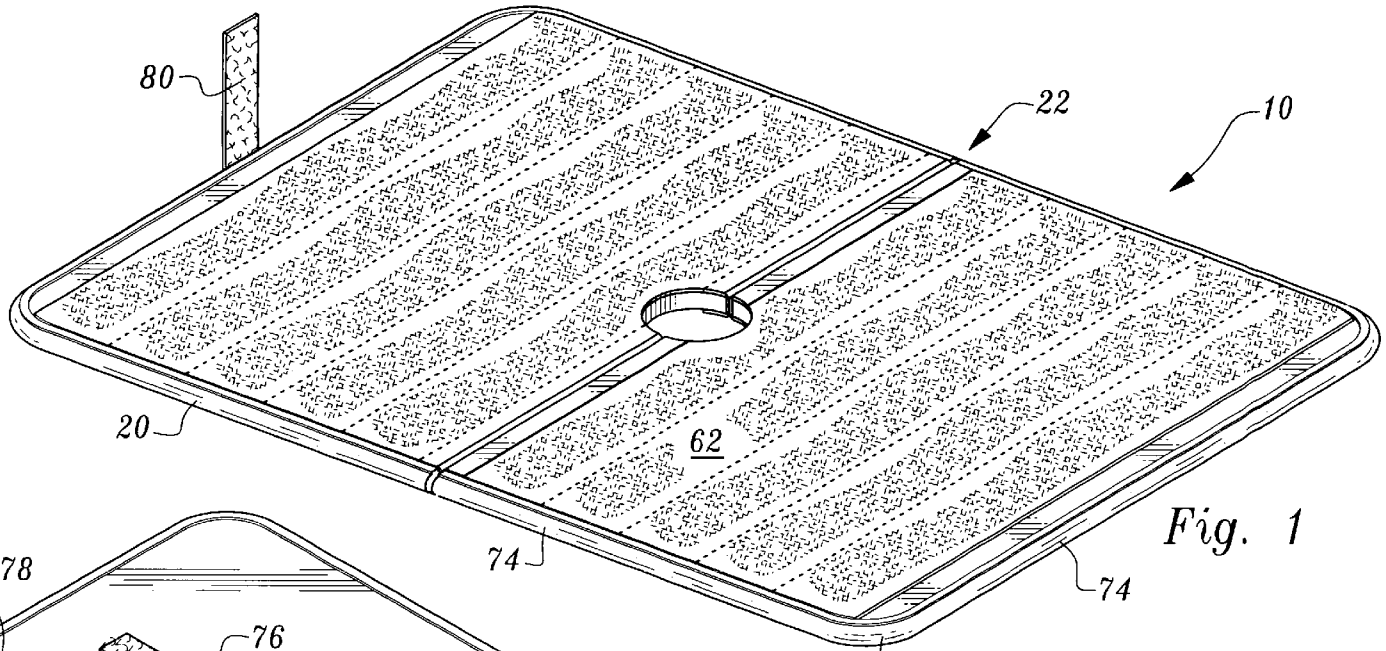
FIG. 1 is a perspective view of the game board of the present invention in its open operative position.

The game board 10 of the present invention includes a generally rigid, form-retaining base member 12 formed of wood, pressed board, metal, plastic, or the like, and has a substantially flat coplanar upper surface 14 and a substantially flat coplanar lower surface 16. In its preferred form, the base member 12, in its operative or playing condition, is of generally rectangular shape having side edge portions 18, and end edge portions 20. The member 12 could have other shapes, such as circular, square, polygonal, or the like, but for reasons to be hereinafter discussed, it is preferred that the base member 12 have a center symmetrically disposed fold line 22 along which the base may be folded in half, with the upper surface 14 of the two halves or sections comprising the base member, folding against each other and with the respective side and end edges being in general alignment.

With a rectangular shaped configuration, the corners are preferably rounded as indicated at 23 to avoid sharp corners and to present a more aesthetic appearance.

Suitable protective trims, such as half round moldings 24 may be placed along the side and end edges of the corners of the board.

Figure 2:
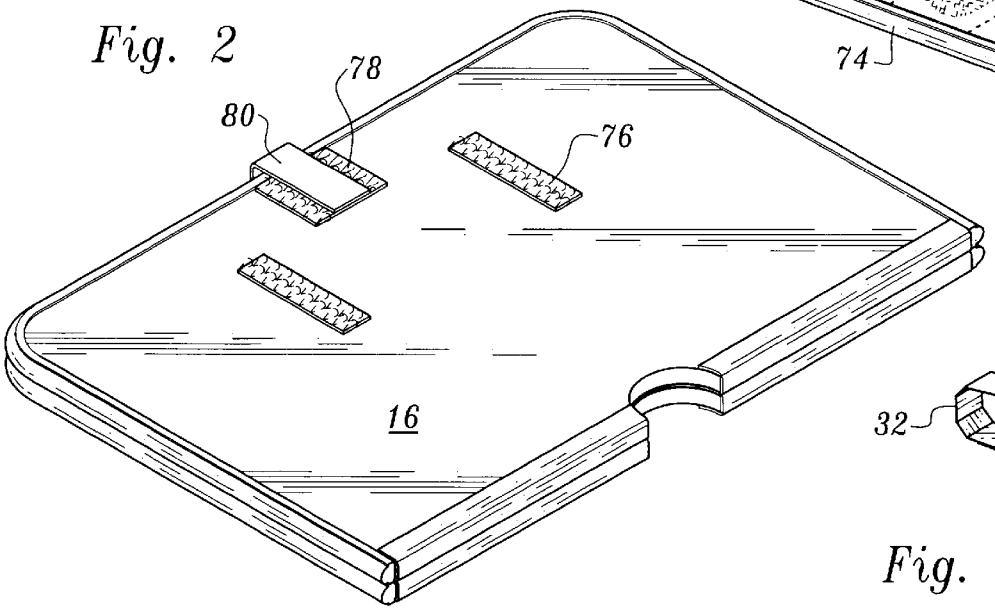
FIG. 2 is a perspective view of the game board of the invention in its folded inoperative position.
Figure 5:
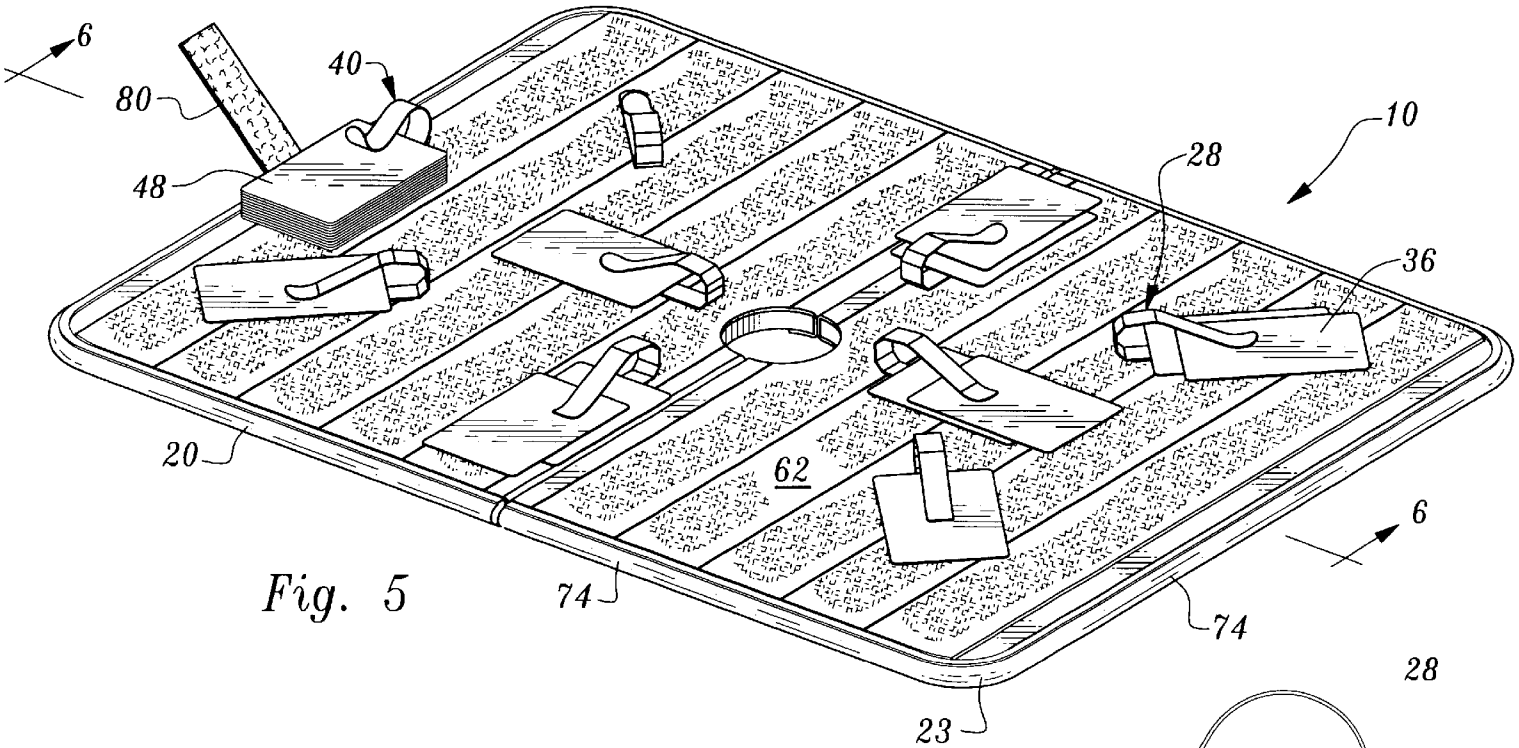
FIG. 5 is a perspective view of the game board with both types of clips in selected positions on the board releasably holding one or more cards.
Figure 6:
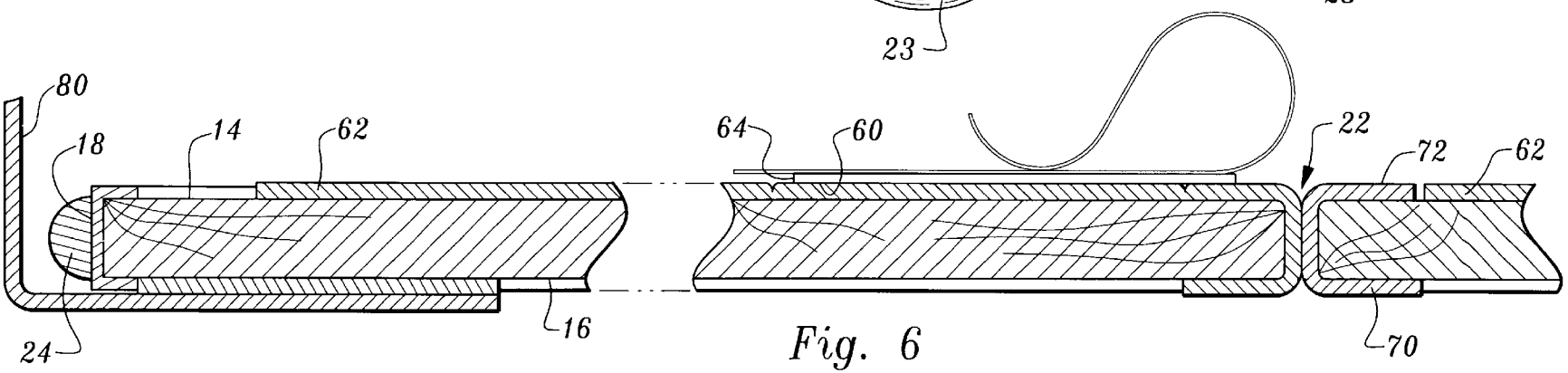
FIG. 6 is a cross section view taken substantially along line 6—6 of FIG. 5 and on an enlarged scale.

FIGS. 1, 5, and 6 illustrate the base member 12 in its open or operative condition. FIG. 2 shows the base member in its folded condition for carrying, storage, or the like. The manner of folding the two sections and securing them in such a folded condition will be later discussed in more detail.

The game board 10 comprises one portion of the present invention, and the other portion consists of one or more clips 28 which may be releasably attached to the upper surface of the game board in any desired position relative to the edges and ends of the board, and in any desired angular orientation relative to such edges and ends. The clips are adapted to releasably hold one or more playing cards which otherwise would be placed on the board and be subject to windy conditions causing the cards to be blown away.

Figure 4:
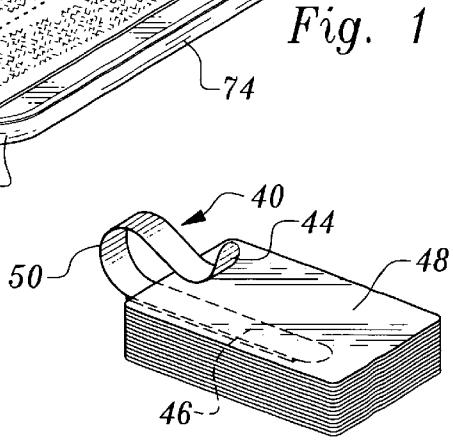
FIG. 4 is a perspective view of a second type of card engaging clip for holding a larger number of cards.
Figure 3:
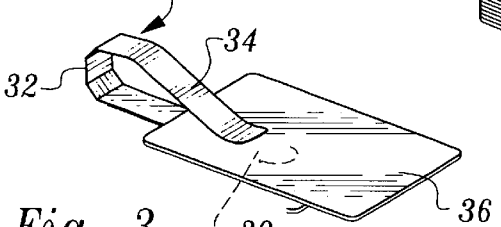
FIG. 3 is a perspective view of one type of card engaging clip for holding a limited number of cards.

The clips 28 are of generally conventional design and may be purchased at most stationery stores. Each clip includes a lower flat base section 30 of generally rectangular configuration having a medial curved section 32 and a distal end section 34 extending back over the base section, with the section 34 being resiliently urged towards the base section by the nature of the curved medial section 32. With this type of clip, one or more playing cards 36 may be inserted between the sections 30 and 34 and held therebetween. When it is believed that a large number of cards are to be releasably held by a clip, the latter may be of the type 40, shown in FIG. 4, similar to clip 28, but with the end section 44 normally spaced from the base section 46 so as to accommodate, for example, a full deck of cards 48. The medial portion 50 will still cause the section 44 to be urged towards the base section so as to hold the stack of cards in place.

The clips and the board are constructed so that any required number of the clips can be releasably secured to the upper surface of the board so as to position one or more cards, or a deck of cards, at substantially any desired location and at any desired angular orientation. The exact number of clips and their location and orientation on the board will depend on the particular card game being played. For example, if two persons are playing gin rummy, it may be desirable to have two clips near the center of the board one for holding undealt cards which may be drawn one at a time by the players, and the other for holding discards. It may also be desired to have one clip adjacent each end of the board to receive the cards initially dealt to each player. If bridge is being played, there would normally be four players, and it may be desirable to place a clip adjacent each side and edge of the board for the dealt cards and additional clips for receiving the cards being played.

The manner of attaching the clips to the board will now be described. In general, the lower surface 60 of the base section of each clip and the upper surface 14 of the game board are respectively provided with hook positions and loop portions of fastening material commercialized under the trademark or trade name VELCRO. As shown, substantially the entire upper surface 14 of the board is covered with a sheet 62 of loop elements of one such Velcro fasteners and the lower surface 60 of each clip is covered, at least in part, by a sheet 64 of the hook elements of the other Velcro fasteners. Thus, each clip can be releasably attached to the board in substantially any location and in any angular disposition. The hook and loop positions can obviously be reversed.

Although the upper surface of the board is illustrated as being the Velcro loop fastener sheet 62 substantially covering such surface, it is clearly within the scope of this invention to have the Velcro material 62 placed in spaced strips or the like, or in small patches in only selected positions on the board where the clips 28 or 40 are likely to be deployed.

At the fold line 22 where the two sections of the game board meet, the looped Velcro fastener sheet 62 on one section overlies its edges at 68 and continues down and around the lower surface 16 of the board at 70. The Velcro fastener sheet 62 on the adjacent section terminates short of the fold line. A hooked or complementary Velcro sheet 72 covers the edge of each adjacent section and a short portion of the upper and lower surfaces of each section. In this manner, the two sections are not only attached to each other by the interaction of the loop and hook elements on the Velcro sheets 68 and 72, but such connection also permits the two sections to be pivotally movable between an open and folded condition. The sheet 72 may be attached to its board by adhesive or any other suitable means.

Preferably, the edge and end positions of the board are also covered with the loop Velcro elements 74 so that in its folded condition, the clips may be attached to such edges for storage or carrying purposes when the board is not being used.

Also, if desired, one or more small sections of looped Velcro elements 76 can be secured to the lower surface 16 of the board 9, (which becomes the exposed surface when the sections are folded) on which clips can also be placed for storage, including a clip capable of holding a deck of cards.

To releasably hold the sections in their folded or stored position, a small section 78 of a looped Velcro element can be secured to a lower surface 16 of one section, and a strip 80 of a hook Velcro element secured to the other base section for releasable attachment to the loop element 78.

What is claimed is:

1. Card game playing apparatus comprising a portable game board having a generally planar horizontal upper surface on which a card game may be played, a first fastener element overlying and covering at least portions of said upper surface, a plurality of card engaging clips each having a lower portion including a generally flat lower surface and an upper portion for releasably grasping at least one card, a second fastener element covering a portion of said lower surface of the lower portion of each of said card engaging clips, one of said fastener elements being the loop portion of a hook and loop fastener, and the other of said fastener elements being the hook portion of the hook and loop fastener whereby each of said card engaging clips may be releasably attached to said upper surface of said game board at a variety of locations and orientations on said game board and said game board is formed of two separable similar parts of substantially equal size and is foldable so that the upper surface of each of said two game board parts may be moved from a first operative position wherein said upper surfaces are substantially coplanar to a second folded position wherein said upper surfaces are parallel and generally contact each other.

2. The apparatus of claim 1 in which the upper portion of each of said card engaging clips is of substantially the same width as said lower portion and vertically overlies the same.

3. The apparatus of claim 2 in which the upper portion of each of said card engaging clips and said lower portion define an open card receiving opening at one end thereof.

4. The apparatus of claim 3 in which the upper and lower portions are resiliently urged together at said card receiving opening so as to releasably secure a card between said portions.

5. The apparatus of claim 3 in which the upper and lower portions of one of said clips are spaced from each other so as to accommodate a deck of stacked playing cards.

6. The apparatus of claim 1 in which the first fastener element overlies substantially the entire upper surface of said game board.

7. The apparatus of claim 1 including a hinge connecting adjacent edges of said two game board parts, said hinge permitting movement of said two parts between said operative and folded positions, said hinge being a second hook and loop fastener extending along abutted edges of two separable game board parts and having a hook portion secured to one of said game board parts and a loop portion secured to the other of said game board parts.

8. The apparatus as set forth in claim 1 in which said game board has a lower surface, and a third hook and loop fastener element corresponding to said first fastener element, said third hook and loop fastener element being secured to said lower surface of said game board at a small area thereof for releasably engaging one of said card engaging clips when said game board parts are in a folded position, said third hook and loop fastener element being at a location on said lower surface that is uncovered when said game board parts are in the folded position.

9. Apparatus as set forth in claim 1 in which at least one edge of said game board is provided with an additional hook and loop fastener element for releasably holding card engaging clips against the edge of the game board.

* * * * *